United States Patent [19]

Beck et al.

[11] 3,957,220

[45] May 18, 1976

[54] SHEET MATERIAL RECEIVING AND STORING APPARATUS

[75] Inventors: Christian A. Beck, Ridgefield; Robert L. Wardwell, Glenbrook, both of Conn.

[73] Assignee: Pitney-Bowes, Inc., Stamford, Conn.

[22] Filed: Nov. 18, 1974

[21] Appl. No.: 524,453

[52] U.S. Cl. ..... 242/67.3 R; 242/68.7; 242/59

[51] Int. Cl.[2] ..... B65H 17/02

[58] Field of Search ..... 242/67.3, 68.7, 59, 242/65, 66, 55.1

[56] References Cited

UNITED STATES PATENTS

| | | | |
|---|---|---|---|
| 2,270,043 | 1/1942 | Fourness et al. | 242/65 |
| 2,742,240 | 4/1956 | Stephens et al. | 242/55.1 |

*Primary Examiner*—Leonard D. Christian
*Attorney, Agent, or Firm*—William D. Soltow, Jr.; Albert W. Scribner; Martin D. Wittstein

[57] ABSTRACT

An apparatus for receiving flat sheet material seriatim and storing the material in rolled configuration on a winding spool. A suitable winding spool is mounted on a frame for rotation, and a plurality of endless belts are mounted on the frame so that a portion thereof is wrapped almost entirely around the spool and another portion is disposed away from the spool to form an entrance portion of the belts adjacent the surface of the winding spool where the belts are tangential thereto. When the belts are driven, sheet material fed between the belts and the peripheral surface of the winding spool and is wrapped around the winding spool and retained thereon for storage.

3 Claims, 3 Drawing Figures

SHEET MATERIAL RECEIVING AND STORING APPARATUS

BACKGROUND OF THE INVENTION

Although the present invention finds utility in a variety of applications, it is intended primarily for use in conjunction with electrophotographic duplicating apparatus for the purpose of providing a storage facility for the masters which such apparatus generates and discards.

Typically, the electrophotographic duplicating apparatus with which this invention is primarily concerned comprises essentially two major components, an electrophotographic copying component which generates a master copy from an original document, and a lithographic press component which utilizes the master to produce ink copies of the original document from the master. The master is produced in the copying component in the typical manner well known in the electrophotographic art, that is, by projecting an image of the original document onto a photoconductive surface of the master which surface has been uniformly electrostatically charged, and then developing the charage image pattern left on the photoconductive surface of the master sheet after exposure thereof to the image projection from the original document by deposition of electrostatically attractible toner particles. The master thus produced is a graphic reproduction of the original document, and would itself constitute a usable copy were it not for the special paper on which this copy is made which is primarily intended for lithographic reproduction. The master is now chemically treated in a known manner so as to render the image areas thereof oleophilic and the background areas thereof hydrophilic so that the image areas will accept lithographic ink but the background areas will not accept the ink.

The master is placed upon a printing drum of the lithographic press component and ink is applied thereto in a manner known in the lithographic press art. Thereafter, sheets of ordinary copy paper are successively fed into the lithographic press and ink is transferred from the image areas of the master to the copy paper to produce the ultimate copies of the original document. The ink may be transferred from the master to the copy paper either directly or through the intermediary of an offset or blanket roll, both of which procedures are well known in the art.

In the type of duplicating apparatus with which the present invention is concerned, the foregoing steps of producing the master in the copying component and utilizing the master in the press component are carried out either semi-automatically or completely automatically. That is, the master can be manually taken from the copying component and inserted into the press component, with the chemical treatment being accomplished in the copying component, in the press component or in between the two. Alternatively, a transfer mechanism can be provided which will take the master from the copying component and transfer it to the press component. In either event, it is typical in apparatus of this type that the master is automatically received by and clamped to the printing cylinder on which the master is wound during a printing operation, and the master is automatically released by and stripped from the printing cylinder when the desired number of ink copies have been produced. The used master is then discarded and a new master comes into operation on the press component.

Until the development of the present invention, no completely satisfactory method or device had been devised for handling the used masters. Typically, the used masters are to some extent wet both from ink and from dampening solution which is used to maintain the background or non-image areas of the master free of ink, and accordingly the masters are rather messy for an operator to handle after being stripped from the printing cylinder. Also, the masters are rather limp in terms of the normal flexibility of paper which characteristic renders the masters difficult to handle by conventional paper handling devices. Still further, the masters typically have a tendency to curl after being discarded from the printing cylinder with the result that stacking of the masters in conventional stacking apparatus is not easily or efficiently achieved. All of these problems render the presently known ways of handling used masters relatively unsatisfactory, particularly in those situations where it is desired to make copies of a large number of original documents and a correspondingly large number of masters are generated during any given reproducing period of operation.

SUMMARY OF THE INVENTION

The present invention relates generally to an apparatus for receiving and storing flat sheet material in rolled configuration, and more particularly to an apparatus for automatically receiving used masters which have been discarded from the printing cylinder of a lithographic press and for winding the masters upon a winding spool for retention and storage thereon.

The present invention obviates or completely overcomes the shortcomings and disadvantages of prior art techniques for handling used lithographic masters by providing an apparatus which, in its broader aspects, comprises a winding spool having a peripheral surface for receiving and winding used lithographic masters thereon, a support means for rotatably supporting the winding spool, a feeding and guiding means mounted on the support means and extending around a major portion of the peripheral surface of the winding spool and being in frictional driving engagement therewith, the feeding and guiding means having a portion which, in operative cooperation with the peripheral surface of the winding spool, forms an entrance for the masters, and means operatively connected with the winding spool and the feeding and guiding means for effecting cooperative movement therebetween for causing the master sheets inserted into the entrance to be wound upon the spool.

In the presently preferred embodiment of the invention, the feeding and guiding means comprises a plurality of endless belts carried by the support means in spaced parallel relation axially of the winding spool in a closed loop path in which each of the belts has a first portion which is wrapped around a major portion of the periphery of the winding spool and a second portion disposed away from the winding spool so that one of the junctures of the first and second portions of the belts forms the entrance for the used masters between the adjacent surface of the belts and the winding spool. It is also preferred that the rotation of the winding spool and concurrent movement of the belts be accomplished by driving the belts from an external power source with the belts frictionally driving the winding spool. Means are provided for removably mounting the winding spool on the support means and for mounting the belts on the support means for movement of at least a portion thereof so as to expose the winding spool for easy removal thereof so that a winding spool with several used masters thereon may be removed from the support means and discarded, and a new winding spool inserted in its place.

Having briefly described the general nature of the present invention, it is a principal object thereof to provide a novel apparatus for receiving and storing flat sheet material in rolled configuration.

It is another object of the present invention to provide an apparatus of the character described which receives used masters from a lithographic press and rolls the masters for storage on a disposable winding spool.

It is still another object of the present invention to provide an apparatus of the character described which can accommodate a large quantity of used masters on a rotating winding spool and which continues to wind used masters thereon although the winding diameter is considerably increased by the accumulated masters.

It is yet another object of the present invention to provide an apparatus of the character described which receives used masters and winds them on a continuously rotating spool and retains the masters thereon in rolled configuration for storage while the winding spool continues to rotate to receive additional used masters.

A still further object of the present invention is to provide a device of the character described which stores the used masters on a disposable winding spool which is readily removable from the apparatus after a predetermined number of used masters has been accumulated.

Yet another object of the invention is to provide an apparatus of the character described which is relatively simple and inexpensive to manufacture and requires little or no maintenance in operation.

These and other objects and advantages of the present invention will become more apparent from an understanding of the following detailed description of a presently preferred embodiment of the invention when considered in conjunction with the accompanying drawings in which.

DETAILED DESCRIPTION

Figure 1:
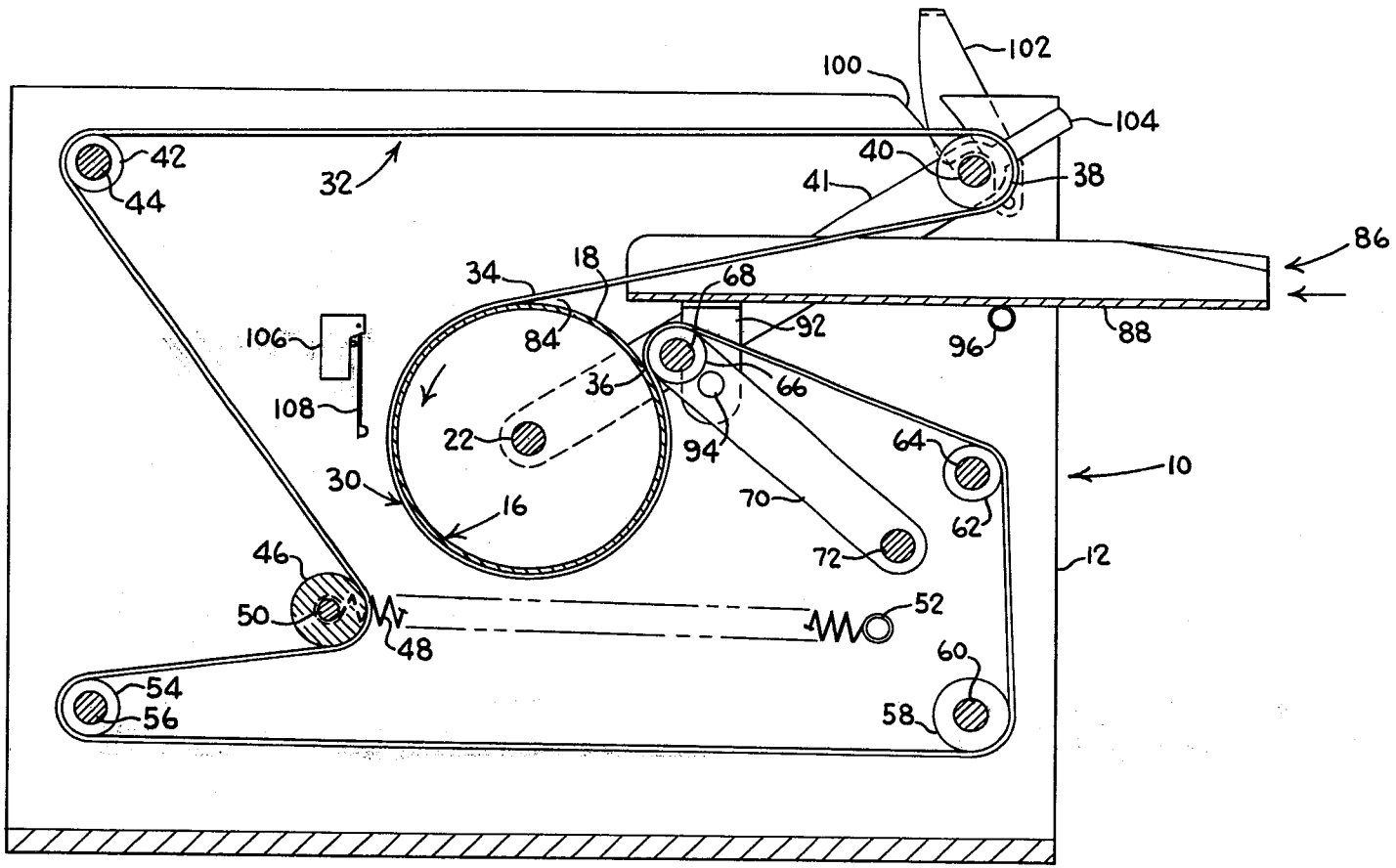
FIG. 1 is a longitudinal sectional view taken on the line 1—1 of FIG. 2 showing the parts of the apparatus in their normal operative position.
Figure 2:
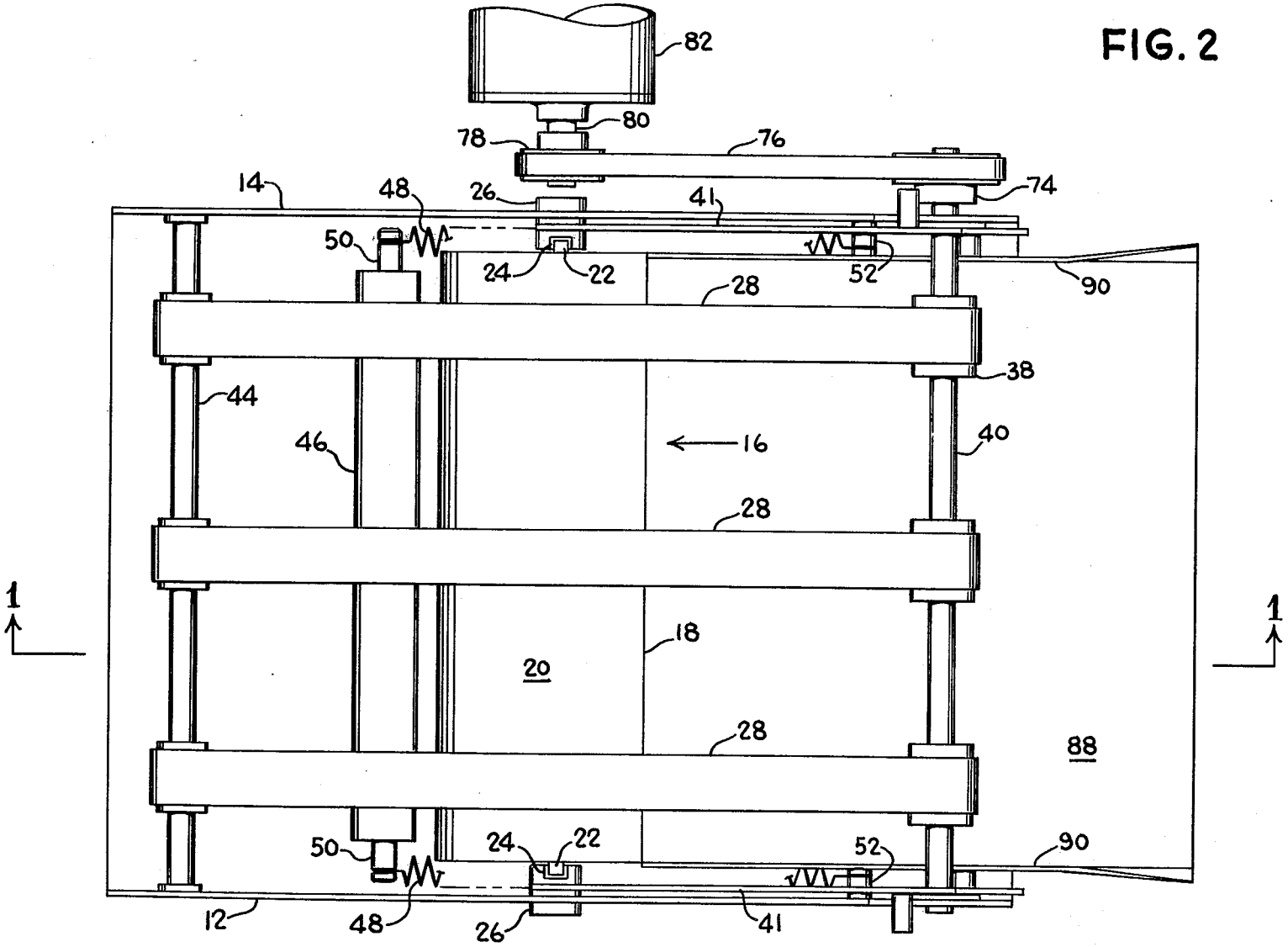
FIG. 2 is a plan view of the apparatus shown in FIG. 1.

Referring to the drawings, and particularly to FIGS. 1 and 2 thereof, the apparatus of the present invention comprises a support means generally designated by the numeral 10 which, in the preferred embodiment of the invention shown in the drawings, is constituted by a pair of spaced apart parallel side walls 12 and 14. It will be recalled that the apparatus of the present invention is intended for use in conjunction with a lithographic press which has the capability of automatically stripping used masters from the printing cylinder and feeding the masters to the storage apparatus. Accordingly, it will be understood that the support means 10 may be an integral part of the lithographic press or it may be a separately fabricated unit which is attached to the press. In either event, it will be understood that the plates 12 and 14 are shown for illustrative purposes only and that other means, including portions of the press as well as any other paper handling machinery, may be utilized in place of the structure shown.

A winding spool generally designated by the numeral 16 is provided upon which the used masters are to be wound. The spool 16 is intended to be disposable and accordingly is fabricated as inexpensively as possible from plastic, cardboard, or any other suitable material which will serve the intended purpose. The spool is composed of a relatively thin hollow core 18 having an outer peripheral surface 20 upon which the masters are adapted to be wound, the core having a diameter which is suitable for winding the type of material being handled. The spool 18 is also provided with any suitable means for removably mounting the spool for rotation on the support means 12, this means being illustratively shown to be a pair of studs 22 projecting from opposite ends of the spool 18. The studs 22 may be integrally formed with any suitable end closure for the core 18 or they may otherwise be connected to the core 18 such as by spokes without the intermediary of end closures since the latter are not necessary to operation of the device; it is sufficient merely that the studs 22 support the core 18. The studs are received in upwardly opening recesses 24 formed adjacent the inner end of a pair of bearings 26 which are fixedly mounted in the side plates 12 and 14 so that the winding spool 16 may readily be inserted into and removed from the apparatus for disposal of a fully loaded spool and replacement with an empty spool in a manner fully described hereinbelow.

Means are provided for feeding and guiding masters onto the winding spool for retention thereon in rolled configuration as the masters are successively transferred from the printing cylinder of the press to the apparatus of the present invention. As will be seen in more detail hereinafter, the feeding and guiding means, which may take a variety of forms, is intended to operatively cooperate with the peripheral surface of the winding spool when the latter is rotating to guide the leading edge of a master onto the surface of the spool and to hold the master in contact with the spool as the latter rotates to cause the master to be wound upon the surface of the spool. It will of course be understood that once a single turn of master sheet material has been wound on the spool, successive turns of that sheet, as well as successive sheets, all wind upon the next preceeding turn of master sheet material; but for ease of reference in this description, as well as in the claims appended hereto, reference is made to the master winding upon the surface of the spool.

In the embodiment illustrated, the feeding and guiding means comprises a plurality of endless belts 28 carried by the support means in spaced parallel relation axially of the winding spool. Each belt has a first portion generally designated by the numeral 30 which extends around a major of the peripheral surface 20 of the winding spool 16, the major portion being something in the nature of about 300° of arc for a purpose to be made clear hereinafter. Each belt has a second portion generally designated by the numeral 32 which is disposed away from the winding spool 16 in a loop configuration so as to form junctures 34 and 36 with the first portion 30 extending around the winding spool 16. As best seen in FIG. 1, the loop portion 32 of the belts 28 commences at the juncture 34 and extends toward the master inlet end of the apparatus to rollers 38 carried by a shaft 40 which is supported by a pair of links 41 which in turn are pivotally connected to the bearings 26 which support the winding spool 16, the pivotal connection of the links being for a purpose to be made clear hereinafter. The belts pass around the rollers 38 and extend rearwardly of the apparatus to other rollers 42 carried by a shaft 44 which is supported by the side plates 12 and 14. From these rollers the belts extend around an elongate floating tensioning roller 46 which is supported by the belts themselves and which are held under tension by the roller 46 as the result of the pull exerted by a pair of tension springs 48 connected at one end to suitable extensions 50 on each end of the roller 46 and at other end to pins 52 carried by the side plates 12 and 14. The location of the tensioning roller 46 is such that the belts extend from the rollers 42 downwardly and forwardly of the apparatus, around the tensioning roller 46, and then rearwardly of the apparatus to pass around additional rollers 54 mounted on a shaft 56 supported by the side plates 12 and 14. From this point the belts extend forwardly of the apparatus to pass around still another set of rollers 58 carried by a shaft 60 supported by the plates 12 and 14. From these rollers, the belts extend upwardly to another set of rollers 62 carried by a shaft 64 supported by the side plates 12 and 14. The belts then extend rearwardly of the apparatus to an elongate roller 66 which is mounted by means of pins 68 on a pair of spaced links 70. The links 70 are mounted for swinging movement on a shaft 72 which is supported by the side plates 12 and 14 for a purpose to be made clear hereinafter. The belts pass around the roller 66 at which point the second loop portion 32 of the belts meets the first portion 30 at the juncture 36 adjacent the peripheral surface of the winding spool 16.

The belts 28 and the winding spool 16 are driven in any suitable manner so as to have cooperative movement therebetween for winding master sheets on the winding spool 16 between the peripheral surface 20 thereof and the adjacent surface of the belts in the first portion 30 thereof. In the embodiment illustrated, the belts are driven by means of the rollers 38 which are non-rotatably carried by the shaft 40, and the shaft 40 is rotated by means of a pulley 74 also carried by the shaft 40, the pulley 74 being driven by a belt 76 which in turn is driven by a pulley 78 mounted on a shaft 80 of motor 82, the latter being suitably mounted with respect to the apparatus. As seen in FIG. 1, the belts are driven in a direction such that they drive the winding spool 16 in a counter-clockwise direction as indicated by the arrow. It will be apparent that the belts drive the winding spool by frictional engagement with the surface 20 thereof when the spool is empty, and by frictional engagement with the masters as the latter accumulate on the winding spool 16.

In order to properly guide the leading edge of an incoming master sheet onto the winding spool so that a smooth winding operation will be achieved, a segment of the belts in the second loop portion 32 between the juncture 34 and the rollers 38 extend straight so that the belts extend tangentially away from the peripheral surface 20 of the winding spool. Thus, this portion of the belts, together with the adjacent surface of the winding spool, forms a converging entrance nip 84 into which the leading edge of a master sheet is fed. To further assist in properly guiding the leading edge of masters onto the winding spool, a delivery tray 86 is provided, the tray 86 having a bottom wall 88 and spaced apart side walls 90. The tray 86 is fixedly supported by the links 70 by means of brackets 92 secured to the links 70 as by the pins 94. The trays are maintained in a substantially horizontal position by a pair of pins 96 which are mounted upon and project inwardly from the walls 12 and 14. It will be apparent that as used master sheets are fed across the delivery table 86, whether manually or by any suitable feeding mechanism, the leading edge of the master will be directed into the entrance 84 above described and will be caught between the adjacent surfaces of the belts and the winding spool for winding upon the latter as a result of concurrent movement of the belts and the winding spool.

As previously indicated, it is intended that the winding spool 16 be disposable and accordingly means are provided to facilitate removal of the winding spool from the apparatus when a certain number of used master sheets has been wound thereon. Thus, as already described, the mounting studs 22 of the core 18 are received in upwardly opening recesses 24 in the bearings 26 so that the winding spool 16 can be lifted from the apparatus. However, in order to do so, both the belts 28 and the tray 86 must be moved from their operative positions shown in FIG. 1 in which these elements interfere with removal of the winding spool to an inoperative position shown in FIG. 3 in which these elements are removed from interfering with removal of the winding spool 16. This is accomplished by making the roller set 38 and the roller 66 movable so as to effectively unwrap the belts from the winding spool and the accumulated masters. Thus the shaft 40 which supports the roller set 38 is carried by the links 41 which are pivotally mounted on the bearings 26, the shaft 40 being supported at its ends in arcuate slots 100 formed in the upper edge of the side plates 12 and 14. Any suitable latch number 102 is provided to normally maintain the shaft 40 in the slots 100, and a suitable handle extension 104 is provided on the outer end of the links 41 to facilitate moving the links. Since the belts 28 are wrapped around the rollers 38, it will be apparent that when the links 41 are moved from the positions shown in FIG. 1 to the position shown in FIG. 3, the rollers 38 are moved therewith and the portions of the belts extending between the rollers 38 and the winding spool 16 and between the rollers 38 and the rollers 42 will be moved to a position in which the belts no longer interfere with upward movement of the winding spool 16 and removal thereof from the apparatus.

Figure 3:
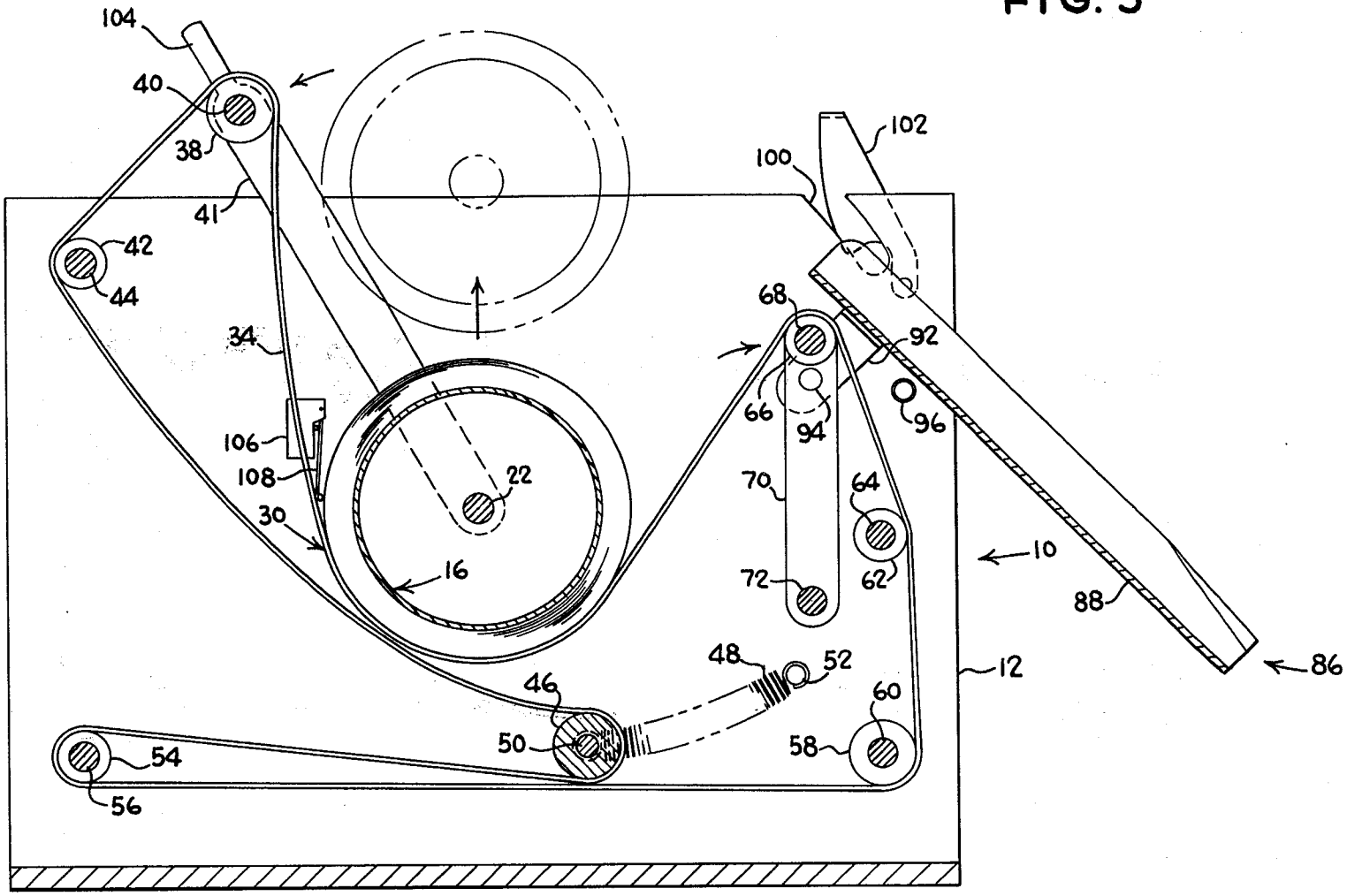
FIG. 3 is a view similar to FIG. 1 but showing the parts in the position they occupy when a fully loaded winding spool is being removed.

Provision is also made for moving both the tray 86 and the portion of the belts passing around the roller 66 away from the winding spool 16 so as not to abstruct the upward movement of the winding spool. Thus, the links 70 are pivotably supported on the shaft 72 so that the links 70 and the roller 66 are movable from the position shown in FIG. 1 to that shown in FIG. 3. This is accomplished by arcuately swinging the tray 86 away from the winding spool 16 so as to pivot the links 70 in a clockwise direction about their pivot axis 72, thereby simultaneously moving both the rollers 66 with the belts 28 passing therearound and the inner end of the tray 86 out of the path of the winding spool during upward movement thereof. It will be seen that movement of both the links 41 and 70 to the positions shown in FIG. 3 provides ready access to the winding spool for removal of a full spool and insertion of an empty spool.

An ancillary feature of the pivotal mounting of the links 70 is that this provides for expansion of the diameter of the winding spool as used master sheets collect thereon. Thus as the diameter of the winding spool increases and the circumferential length of the first belt portion 30 also increases, some of the slack in the belts 28 is taken up in the vicinity of the tensioning roller 46 to accommodate the increase in the length of the first belt portion 3o, and the links 70 and roller 66 move slightly away from the winding spool. This movement of the links 70 also moves the tray 86 slightly in the same direction as the links 70 and this has the effect of maintaining the projected direction of the tray bottom 88 substantially tangential with the surface of the master sheet material on the winding spool as the thickness of sheets thereon increases.

As a safety precaution against loading the winding spool with master sheets in excess of the capacity of the apparatus, a sensing switch 106 is suitably mounted on the apparatus in position to have the switch arm 108 thereof contacted by the outer surface of a master sheet when a predetermined number of master sheets has been accummulated. At that point either the master loading apparatus 10 is shut down and a warning light is caused to appear on the control panel of the copier duplicator apparatus indicating that the winding spool needs replacement or the entire copier duplicator apparatus is caused to shut down depending on the manner of wiring the switch 106.

Having described and illustrated a preferred embodiment of the present invention, it will be apparent that various modifications and alternations may be made thereto and it is intended that the scope of the present invention shall be limited only as defined in the appended claims.

What is claimed and desired to be secured by Letters Patent is:

1. Apparatus for receiving and storing flat sheet material in rolled configuration comprising:

a. a winding spool having a peripheral surface for receiving and winding flat sheet material thereon;

b. support means;

c. means carried by said support means for rotatably and removably supporting said winding spool in a fixed position relative to said support means;

d. a plurality of endless belts carried by said support means in spaced parallel relation axially of said winding spool;

e. means mounting said belts on said support means in a closed loop path in which each of said belts has 1. a first portion extending around a major portion of said peripheral surface of said winding spool and being in frictional driving contact therewith, and 2. a second portion which is disposed away from said peripheral surface of said winding spool to form junctures with said first portion, said belts forming a converging entrance nip with the peripheral surface of said winding spool in the vicinity of one of said junctures of said first and second belt portions for receiving flat sheet material in said nip, and f. means for concurrently driving said belts and rotating said winding spool in a direction to draw sheet material into said nip and cause said sheet material to be wound upon said peripheral surface of said winding spool.

2. Apparatus as set forth in claim 1 wherein said means mounting said belts on said support means includes means for mounting a portion of said belts on said support means for movement toward and away from said peripheral surface of said winding spool, said movable mounting means including a guiding surface carried by said movable mounting means for directing sheet material into said entrance nip substantially tangentially relative to said peripheral surface of said winding spool, whereby as sheet material accumulates on said winding spool and the effective diameter thereof increases, said guiding surface moves with said movable mounting means to maintain said guiding surface substantially tangential to the outermost piece of sheet material on said winding spool.

3. Apparatus as set forth in claim 2 wherein said means for movably mounting said portion of said belts comprises a roller around which said belts pass, said roller being carried by a pair of links pivotally connected to said support means, and wherein said guiding surface is fixedly mounted on said links whereby as said links move about the pivotal connection thereof with said support means in response to sheet material accumulating on said winding spool, said guiding surface is correspondingly rotated to maintain said tangential relationship.

* * * * *